United States Patent [19]

Barmatz et al.

[11] Patent Number: 4,520,656

[45] Date of Patent: Jun. 4, 1985

[54] GRAVITY ENHANCED ACOUSTIC LEVITATION METHOD AND APPARATUS

[75] Inventors: Martin B. Barmatz, Glendale; James L. Allen, LaCrescenta; Dan Granett, Los Angeles, all of Calif.

[73] Assignee: The United States of America as represented by the Adminstrator of the National Aeronautics and Space Administration, Washington, D.C.

[21] Appl. No.: 559,988

[22] Filed: Dec. 9, 1983

[51] Int. Cl.[3] ..... G10K 10/00

[52] U.S. Cl. ..... 73/505

[58] Field of Search ..... 73/505

[56] References Cited

U.S. PATENT DOCUMENTS 3,882,732 5/1975 Fletcher et al. ..... 73/505

4,218,921 8/1980 Oran et al. ..... 73/505

*Primary Examiner*—Stewart J. Levy

*Assistant Examiner*—John E. Chapman, Jr.

*Attorney, Agent, or Firm*—Paul F. McCaul; John R. Manning; Thomas H. Jones

[57] ABSTRACT

An acoustic levitation system is provided for acoustically levitating an object, by applying a single frequency from a transducer into a resonant chamber surrounding the object. The chamber includes a stabilizer location (29, FIG. 2) along its height, where the side walls of the chammber are angled so they converge in an upward direction. When an acoustic standing wave pattern is applied between the top and bottom of the chamber, a levitation surface (28) within the stabilizer does not lie on a horizontal plane, but instead is curved with a lowermost portion (31) near the vertical axis of the chamber. As a result, an acoustically levitated object (30) is urged by gravity towards the lowermost location (31) on the levitation surface, so the object is kept away from the side walls of the chamber.

8 Claims, 8 Drawing Figures

FIG. 1
PRIOR ART
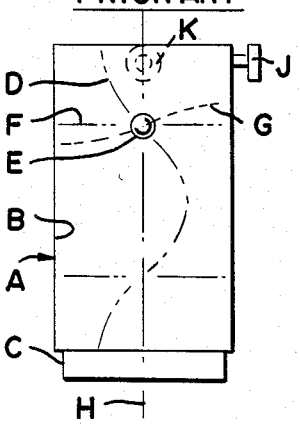
FIG. 2
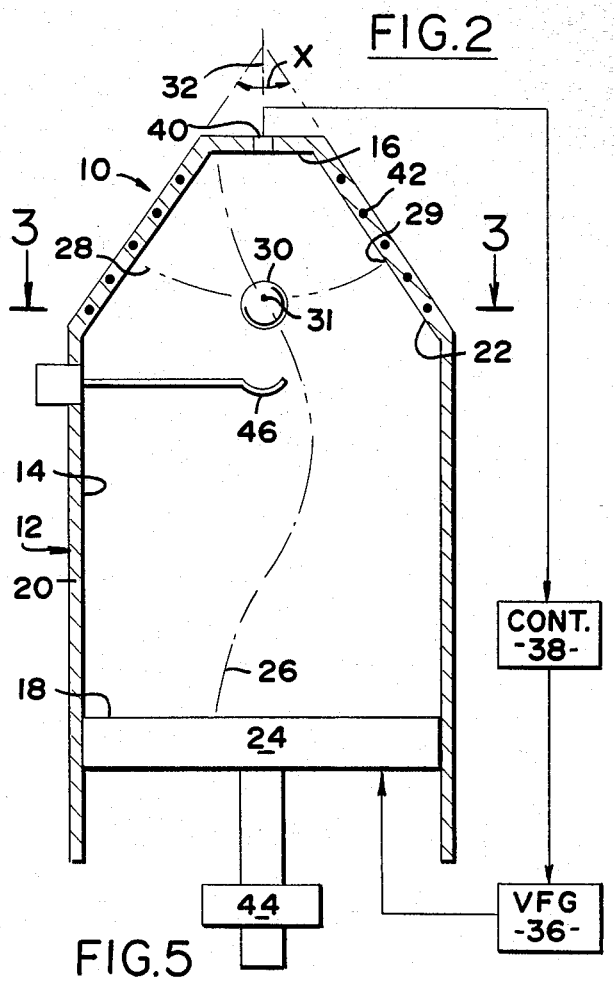
FIG. 3
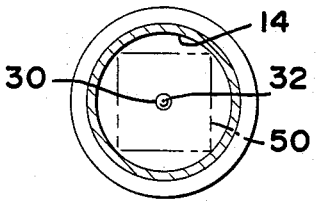
FIG. 4
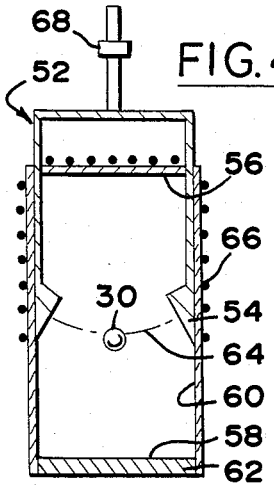
FIG. 5
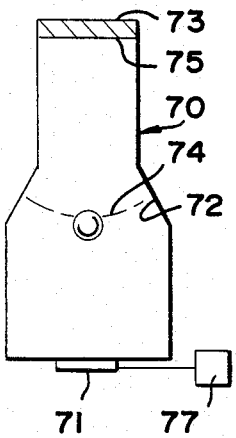
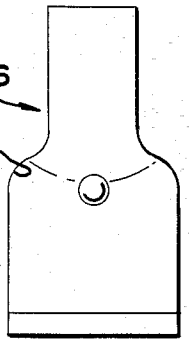
FIG. 6
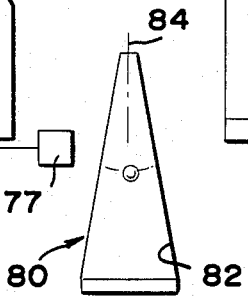
FIG. 7
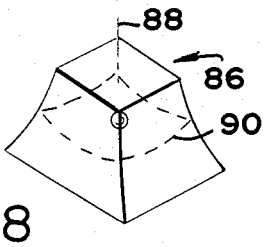
FIG. 8

GRAVITY ENHANCED ACOUSTIC LEVITATION METHOD AND APPARATUS

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

An object can be acoustically levitated within a chamber having a vertical axis, flat top and bottom walls, and a uniform cross-section along its height. Levitation is accomplished by applying acoustic energy resonant to the height of the chamber, so the object is levitated near an acoustic levitation surface, which is at an acoustic potential minimum of the standing wave pattern. Such a levitation surface will lie in a horizontal plane (corresponding to a pressure node). As a result, the position of the object is not localized, but has an equal probability of being situated at any position on the surface, including the walls of the chamber. Since a major purpose of acoustic levitation is to avoid the direct contact of a levitated object with a solid support, for reasons such as to avoid contamination of the object when it is heated to a liquid temperature, means must be provided to keep the object away from the walls of the chamber. One technique is to also establish acoustic standing wave patterns along one or two horizontal directions within the chamber. However, the need to apply such horizontal standing wave patterns or use other means to position the object in the center of the chamber, adds to the complexity of a levitation system. A levitation system which enabled the positioning of an object so that it not only did not move downwardly, but also so it did not move sidewardly against the walls of the chamber, using a single frequency to form a single acoustic standing wave pattern within the chamber, would be of considerable value.

SUMMARY OF THE INVENTION

In accordance with one embodiment of the present invention, an acoustic levitation apparatus and method are described which enable a single acoustic frequency to be applied to a chamber to position an object within the chamber along three dimensions. The apparatus includes a chamber with side walls that form a stabilizer location at a position along the height of the chamber, where the side walls are angled so they converge in an upward direction. Means are provided for applying acoustic energy to the chamber at a frequency which is resonant to the height of the chamber to produce a standing wave pattern along the height of the chamber. An acoustic standing wave pattern is chosen which produces an acoustic levitation surface(s), to which objects are urged, at the height of the stabilizer location. The resulting acoustic levitation surface(s) is curved so that it has a lowest point spaced from the side walls of the chamber. The object is urged towards the lowest point by gravity or other downward force. Thus, the acoustic standing wave pattern supports the object against the force of gravity or other force urging it in a downward direction, while the gravity or other force also urges the object towards the lowermost position on the curved levitation surface to hold the object away from the walls of the chamber.

The novel features of the invention are set forth with particularity in the appended claims. The invention will be best understood from the following description when read in conjunction with the accompanying drawings.

BRIEF DESCRIPTION OF THE DRAWINGS

FIG. 1 is a sectional view of a prior art levitation system.

FIG. 2 is a sectional side view of a levitation system constructed in accordance with one embodiment of the present invention.

FIG. 3 is a partial sectional view taken on the line 3—3 of FIG. 2.

FIG. 4 is a sectional view of a levitation system constructed in accordance with another embodiment of the invention.

FIG. 5 is a sectional view of a levitation system constructed in accordance with another embodiment of the invention.

FIG. 6 is a sectional view of a levitation system constructed in accordance with another embodiment of the invention.

FIG. 7 is a sectional view of a levitation system constructed in accordance with another embodiment of the invention.

FIG. 8 is a perspective view of a levitation system constructed in accordance with another embodiment of the invention.

DESCRIPTION OF THE PREFERRED EMBODIMENTS

FIG. 1 illustrates a levitation system A of the prior art which includes walls forming a chamber B and a transducer C which establishes an acoustic standing wave pattern along the height of the chamber, as represented at D. An object E is supported near an acoustic levitation surface F resulting from the acoustic standing wave pattern. While the object is prevented from falling, it is not prevented from drifting against the side walls of the chamber. In order to hold the object near the center of the chamber, an additional standing wave pattern, indicated at G is established within the chamber, which has an acoustic potential minimum along the vertical center line H of the chamber. This may be accomplished by using another transducer J which is coupled to the chamber. When the chamber is of rectangular cross-section along the height H, an additional transducer K may be required to establish another standing wave pattern which is perpendicular to both of the other standing wave patterns indicated at D and G.

In accordance with the present invention, a single standing wave pattern can be used not only to levitate an object against a force such as gravity, but also to position or levitate an object in perpendicular direction such as along the two horizontal dimensions of a chamber.

FIG. 2 illustrates an acoustic levitation system of the present invention 10 which includes walls 12 forming a chamber 14 having a top and bottom 16, 18 and having side walls 20. The side walls form a stabilizer portion 22 along the height of the chamber, where the side walls of the chamber are angled so that they converge in an upward direction. When a transducer 24 is energized to produce the standing wave pattern 26 which has an acoustic levitation surface at 28 which is at the same height as a location 29 along the stabilizer portion 22, the levitation surface 28 does not lie in a horizontal plane, but instead is curved so that it is concave when viewed from the top of the chamber.

Acoustic forces urge the levitated object 30 to lie on the levitation surface 28. However, gravity urges the object 30 toward the lowest point 31 along the levitation surface, which lies on or near the vertical axis 32 of the chamber. Thus, the force of gravity on an object lying on the curved levitation surface 28 automatically urges the object away from the walls of the chamber, so that no auxiliary standing wave pattern or the like is necessary to keep the object away from the wall of the chamber.

The levitation surface 28 is curved because where it meets the side walls of the chamber the levitation surface extends perpendicular to the side walls. The greater the angle of convergence X at the stabilizer location 29 where the object is levitated, the greater the sideward force urging the object towards the center line 32 of the chamber. It may be noted that in a rectangular chamber the levitation surface to which an object is acoustically urged, coincides with a pressure node of the standing wave pattern which is where the acoustic pressure is a minimum. However, there are other systems where the levitation surface does not coincide with the location of pressure nodes. Accordingly, the term "levitation surface" is used to describe the location (position of the acoustic potential minimum) to which the object is urged by acoustic forces. It is also noted that the object typically lies below the acoustic surface, at a location where the upward acoustic forces equal the downward gravity forces. It also should be noted that when the system is used in an outer space environment where there is zero gravity, other forces such as the force of centrifugal motion or electostatic or magnetic forces may be used in place of gravity and the "downward" direction is a direction in which the object is urged by such nonacoustic forces.

In the system 10 of FIG. 2, the transducer 24 is driven by electrical signals generated by a variable frequency generator 36. The precise frequency output of the generator 36 is controlled by a control 38 which is connected to an acoustic pressure sensor 40 that senses the pressure at the top of the chamber. The control 38 adjusts the frequency of the acoustic energy to maintain it substantially at a resonant frequency. In some applications, the object 30 must be heated to a molten temperature, which can be accomplished by the use of heating coils 42 located near the stabilizer location 29. An actuator 44 can move the bottom wall up and down to vary the height of the chamber so the resonant frequency does not have to vary within a very wide range. This adjustable height chamber is necessary when fixed frequency transducers are used. The object 30 can be placed on a holder 46 which is inserted into the chamber, so acoustic pressure lifts the object off the holder and up towards the levitation surface 28.

The chamber 14 can have a variety of shapes. FIG. 3 shows the particular chamber 14 as having a circular cross-section as taken along the vertical axis 32, but the chamber could be constructed with a square or rectangular cross-section as shown at 50.

FIG. 4 shows another system 52 which includes a stabilizer 54 spaced from both the top 56 and bottom 58 of a chamber 60. The bottom wall 58 is the upper surface of a transducer 62. The stabilizer 54 is located, and the transducer 62 is driven at a resonant frequency, to produce a levitation surface 64 at which the object 30 is levitated.

The upper portion of the chamber is situated within a furnace 66. The position of the stabilizer section may be varied along the height of the chamber by a motor 68. After a sample has been processed at high temperature it can be moved out of the furnace area by simultaneously lowering the stabilizer region and changing the frequency to different resonant frequencies to maintain levitation of the sample.

FIG. 5 illustrates another system 70 wherein the walls of the chamber are vertical along most of the height of the chamber, but have a smaller cross-sectional area at the upper end of the chamber than at the lower end. The transition region 72 forms a stabilizer portion at which a levitation surface 74 is curved so it is concave in an upward facing direction. The transducer 73 is coupled to the top 75 of the chamber, where there is the smaller cross-sectional area, to produce maximum acoustic intensity at 74.

The bottom wall of the chamber includes a trap door 71 that can be opened by an actuator 77 to allow the object to fall through. When the object or sample is finished being processed in a furnace formed by the walls of the chamber 72 which includes heating coils (not shown), the sample can be dropped out of the bottom of the chamber into a coolant (not shown) by simultaneously turning off the sound signal and opening the trap door. In this way samples can be quickly cooled.

FIG. 6 shows a similar system 76, wherein the transition region which forms the stabilizer portion 78, is continually curved rather than cone shaped.

FIG. 7 shows another system 80 wherein the chamber 82 has side walls that are angled from the vertical axis 84 along the entire height of the chamber. It should be noted that the greater the portion of the chamber which is angled from the horizontal, the greater the deviation of the resonant frequency from a frequency which is resonant to a chamber having flat horizontal upper and lower walls and a uniform cross-section throughout its entire height, as in the case of the chamber shown in FIG. 1.

FIG. 8 shows another system 86 of rectangular cross-section along its vertical axis 88, and with the walls of the chamber curved so they converge in an upward direction but at varying angles. The concave curvature of the levitation surface 90, which can be appreciated in this figure, has its lowest position within the chamber.

Thus, the invention provides acoustic levitation systems for use in environments wherein a gravity or other force urges an object in a predetermined downward direction, which enables the levitation of an object so it is held against movement in all three dimensions, with the application of a single acoustic standing wave pattern within the chamber. The systems include walls forming a chamber having a top, bottom, and side walls, with the side walls including a stabilizer portion along which the side walls are angled from the vertical to converge in an upward direction. A means for establishing an acoustic wave pattern within the chamber, creates an acoustic levitation surface at a stabilizer location along the height of the stabilizer portion. An object located near the levitation surface, can be supported near the levitation surface against the downward pull of gravity or other force, but also is urged towards a lowermost location on the levitation surface which is spaced from the walls of the chamber.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. An acoustic levitation system for use in an environment wherein a gravity or other force urges an object in a predetermined downward direction, comprising:

walls forming a chamber having a top wall, a bottom wall, and side walls, said side walls forming a stabilizer location at a position along the height of said chamber where said side walls are angled so they converge in an upward direction; and means for applying acoustic energy to said chamber at a frequency which is resonant to the height of said chamber to produce a standing wave pattern along the height of the chamber, said frequency chosen so there is an acoustic levitation surface at the height of the stabilizer location.

2. The system described in claim 1 wherein:

said chamber has a height, as measured between its top wall and bottom wall, and said side walls extend vertically along most of the height of said chamber.

3. The system described in claim 2 wherein:

said chamber has an upper portion of substantially constant cross-section, and a bottom portion of substantially constant cross-section, the cross-sectional area of the upper portion being less than that of the lower portion, and said chamber forms a transition region between said upper and lower portions, said stabilizer location being positioned at said transition region.

4. The system described in claim 1 wherein:

said side walls form a stabilizer portion along which the side walls are angled to converge in an upward direction, said stabilizer location lying at a position on said stabilizer portion, said stabilizer portion being spaced from both the top wall and bottom wall of said chamber and said side walls being vertical both above and below said stabilizer portion.

5. The system described in claim 1 wherein:

said side walls are angled from the vertical along the entire height of the chamber.

6. The system described in claim 1 including:

an object suspended at said acoustic levitation surface.

7. The system described in claim 1 wherein:

said top wall and bottom wall form opposite ends of said chamber; and said acoustic energy applying means includes a transducer coupled to one end of said chamber, a variable frequency generator coupled to said transducer to drive it, an acoustic pressure sensor coupled to an end of said chamber, and signal generator means coupled to said generator and said sensor for varying the frequency of said generator to maintain said resonant frequency.

8. A method for acoustically levitating an object comprising:

establishing said object within a chamber having a top wall, bottom wall, and side walls at the height of a stabilizer portion formed by the side walls of said chamber wherein the side walls of the chamber are angled so they converge in an upward direction; and establishing an acoustic standing wave pattern along the height of said chamber which produces an acoustic levitation surface at the height of said stabilizer portion.

* * * * *